United States Patent [19]

Fujimoto et al.

[11] Patent Number: 5,044,036

[45] Date of Patent: Sep. 3, 1991

[54] BLIND WASHING APPARATUS

[75] Inventors: Takenobu Fujimoto, Kamifukuoka; Michinobu Fujiwara, Ichikawa; Naoto Sakaiya, Nerima, all of Japan

[73] Assignee: Aderans Co., Ltd., Tokyo, Japan

[21] Appl. No.: 392,911

[22] PCT Filed: May 30, 1988

[86] PCT No.: PCT/JP88/00527

§ 371 Date: Aug. 2, 1989

§ 102(e) Date: Aug. 2, 1989

[30] Foreign Application Priority Data

Dec. 28, 1987 [JP] Japan ..... 62-197584[U]
Dec. 28, 1987 [JP] Japan ..... 62-197585[U]
Dec. 28, 1987 [JP] Japan ..... 62-197586[U]
Feb. 2, 1988 [JP] Japan ..... 63-13411[U]

[51] Int. Cl.[5] ..... A47L 4/00
[52] U.S. Cl. ..... 15/88.1; 15/77
[58] Field of Search ..... 15/21.1, 215, 77, 102, 15/88.1; 134/6

[56] References Cited

U.S. PATENT DOCUMENTS 2,318,884 5/1943 O'Kelley ..... 15/77
2,682,676 7/1954 Franchi ..... 15/77
3,314,819 4/1967 Dyer ..... 15/77

FOREIGN PATENT DOCUMENTS 625754 2/1936 Fed. Rep. of Germany ..... 15/77

*Primary Examiner*—Edward L. Roberts
*Attorney, Agent, or Firm*—Nixon & Vanderhye

[57] ABSTRACT

A blind washing apparatus capable of washing a blind automatically without relying upon manual operation. The blind is supported by a blind support device and repeats upward and downward movements. In a state in which the blind is lowered into a washing tank filled with washing liquid, the blind is brushed by a pair of washing brushes arranged in opposed relation to each other, thereby washing the blind automatically.

20 Claims, 12 Drawing Sheets

BLIND WASHING APPARATUS

TECHNICAL FIELD

The present invention relates to a blind washing apparatus for automatically washing a so-called venetian blind or the like having a multiplicity of horizontally extending blades which are arranged one over another in vertically spaced relation to each other.

BACKGROUND ART

Generally, a so-called venetian blind having a multiplicity of horizontally extending blades arranged one over another in vertically spaced relation to each other has widely been employed on a window of a room or the like in order to keep off the sun. In such blind, the dust and nicotine of tobacco are apt to adhere to the surfaces of the respective blades so that the blind is promptly contaminated. However, the blind is so constructed as to be extremely difficult to be washed, because each blade is not fixedly mounted in order and because each blade has flexibility.

Because of the above reason, washing of the blind is conventionally a hand-washing or hand-scrubbing operation in which gloves are worn and detergent or the like is applied to the gloves for wiping off both sides of each blade. Accordingly, the washing operation is extremely inefficient, and there is the possibility that the blades may be damaged during the washing. Accordingly, treatments of the blind such as cleaning, washing and the like are not infrequently carried out.

It is therefore an object of the invention to provide a novel blind washing apparatus capable of automatically washing the above-described blind without relying upon troublesome manual operation.

DISCLOSURE OF THE INVENTION

According to the invention, the above object is achieved by a blind washing apparatus comprising a washing section for washing a blind, and a blind support device for supporting the blind in a developed manner and for reciprocating the blind vertically relatively to the blind washing section, wherein the blind washing section includes a washing tank accommodating the blind at a lowered position thereof and capable of being filled with washing liquid, and a pair of washing brushes arranged in opposed relation to each other substantially along a longitudinal direction so as to clamp the blind from its opposite sides within the washing tank, and wherein surfaces of blades of the blind dipped in the washing liquid are brushed by the washing brushes with the vertical movement of the blade, thereby carrying out washing of the blind.

The blind washing apparatus according to the invention may be so arranged that nozzles are arranged in the vicinity of an upper end of the washing tank along the longitudinal direction thereof, and the washing liquid within the washing tank is injected to the blind through the nozzles.

Further, the aforesaid blind washing section may be so arranged that a second tank is provided for storing detergent liquid, the detergent liquid is transferred from the second tank to the washing tank at the beginning of a washing step of the blind, and the detergent liquid is returned from the washing tank to the second tank at the end of the washing step of the blind. Moreover, a third tank may be arranged for storing washing water. Nozzles are arranged above and along the washing brushes, and the washing water from the third tank is injected to the vertically moving blind through the nozzles after the washing step of the blind by the detergent liquid, thereby carrying out rough rinsing of the blind. Furthermore, a fourth tank may be arranged for storing new water, and the new water from the fourth tank is injected toward the vertically moving blind through the nozzles after the injection of the washing water, thereby carrying out finishing rinsing.

The term "washing liquid" in this specification is used to mean any one of the aforesaid detergent liquid, washing water or the new water for rinsing, or is used as a general term for them.

According to this invention, washing of the blind, which has conventionally been incapable of being done without relying upon the manual operation, can be performed automatically simply and reliably. In particular, if the apparatus is portable, for example, capable of being loaded on a truck or the like, it is possible to wash many blinds during a short period of time without the necessity of many hands.

Further, according to another aspect of the invention, the above-mentioned object is achieved by a blind washing apparatus comprising a washing section for washing a blind, and a blind support device for supporting the blind in a developed manner and for vertically reciprocating the blind relatively to the blind washing section, the blind washing section including a washing tank accommodating the blind at a lowered position thereof and capable of being filled with washing liquid, and washing brushes arranged in opposed relation to each other so as to clamp the blind from its opposite sides substantially along a longitudinal direction within the washing tank, the washing brushes being reciprocated horizontally in their respective directions opposite to each other along the longitudinal direction and surfaces of blades of the blind dipped in the washing liquid being brushed by the washing brushes with the vertical movement of the blind within the washing tank, wherein washing-brush support members supporting respectively the aforesaid two washing brushes are connected at their opposite ends to connecting members through universal joints, wherein at least one of the connecting members is pivotally supported at its central section for angular movement about a vertical shaft, and wherein swinging movement of the connecting member causes the washing brushes to be reciprocated substantially arcuately along the longitudinal direction.

According to this aspect, the two washing brushes are reciprocated arcuately along the longitudinal direction and, with the reciprocative movement, the washing brushes repeat their movement toward and away from each other. Thus, when each blade of the blind is washed, the washing brushes operate so as to sweep away the dust and the like adhered to the blades. That is, the washing brushes operate in such a manner that when the washing brushes move toward each other, the washing brushes are abutted strongly against the blade to remove the dust and the like from the blade surface. When the washing brushes move away from each other, the washing brushes are brought into light contact with the blade surface to sweep away the removed dust and the like. Further, when the washing brushes move away from each other, each blade is caused to pass easily through a gap between the washing brushes. Accordingly, each blade is prevented from being caught by the washing brushes during the washing operation. Thus, it can be ensured that the front and back sides of each blade are washed by the washing brushes.

According to still another aspect of the invention, the above object is achieved by a blind washing apparatus comprising a washing section for washing a blind, and a blind support device for supporting the blind in a developed manner and for reciprocating the blind vertically relatively to the blind washing section, the blind washing section including a washing tank accommodating the blind at a lowered position thereof and capable of being filled with washing liquid, and washing brushes arranged in opposed relation to each other so as to clamp the blind from its opposite sides substantially along a longitudinal direction within the washing tank, surfaces of blades of the blind dipped in the washing liquid being brushed by the washing brushes with the vertical movement of the blind within the washing tank, wherein washing-brush support members supporting respectively the aforesaid two washing brushes are arranged at least their respective one ends for horizontally reciprocative movement in their respective directions opposite to each other perpendicularly to the longitudinal direction.

According to this aspect, the two washing brushes repeat their movement toward and away from each other relative to the blades of the blind during the washing, whereby the washing brushes move so as to sweep forwardly away the dust and the like adhered to each blade. That is, when the washing brushes move toward each other, the washing brushes are abutted strongly against the blades to remove the dust and the like from the blade surfaces, while when the washing brushes then move away from each other, the washing brushes are brought into light contact with the blade surfaces, thereby sweeping away the removed dust and the like. Further, since, in the state in which the brushes are spaced away from each other, each blade is permitted to pass easily through a gap between both the washing brushes, it is prevented that each blade is caught by the washing brushes during the operation. Thus, it is ensured that the front and back sides of each blade are washed.

BEST MODE FOR CARRYING OUT THE INVENTION

Figure 1:
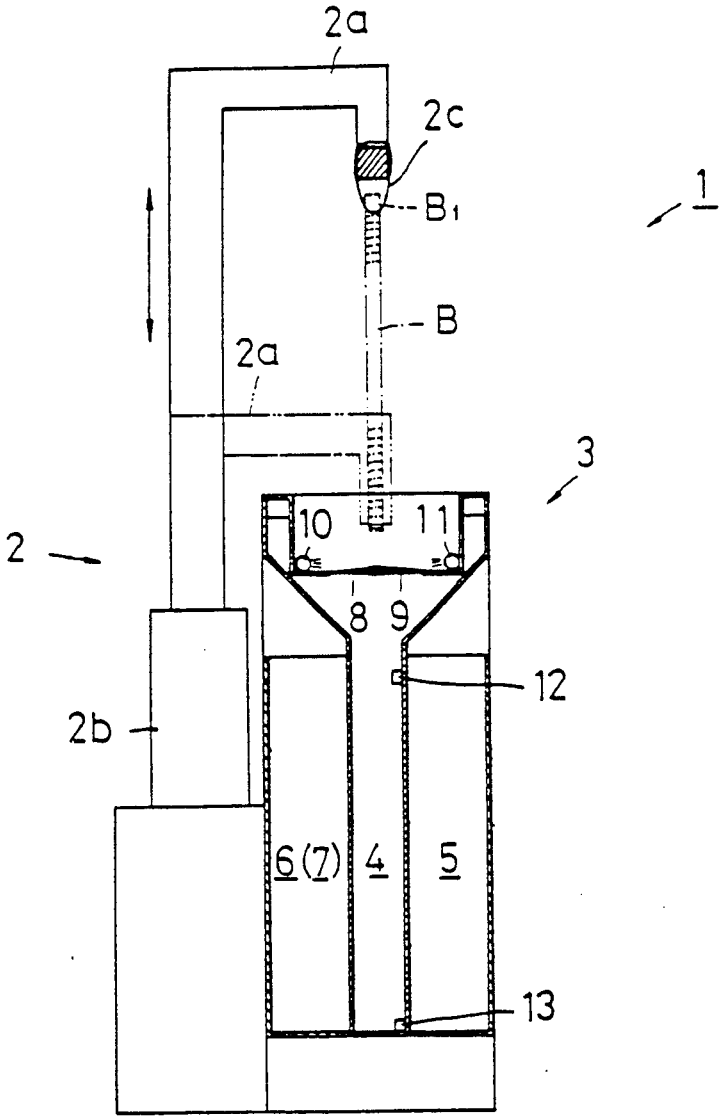
FIG. 1 is a partial cross-sectional diagrammatic side elevational view of a blind washing apparatus according to a first embodiment of the invention.

The invention will be described below in detail with reference to several embodiments shown in the drawings.

Figure 2:
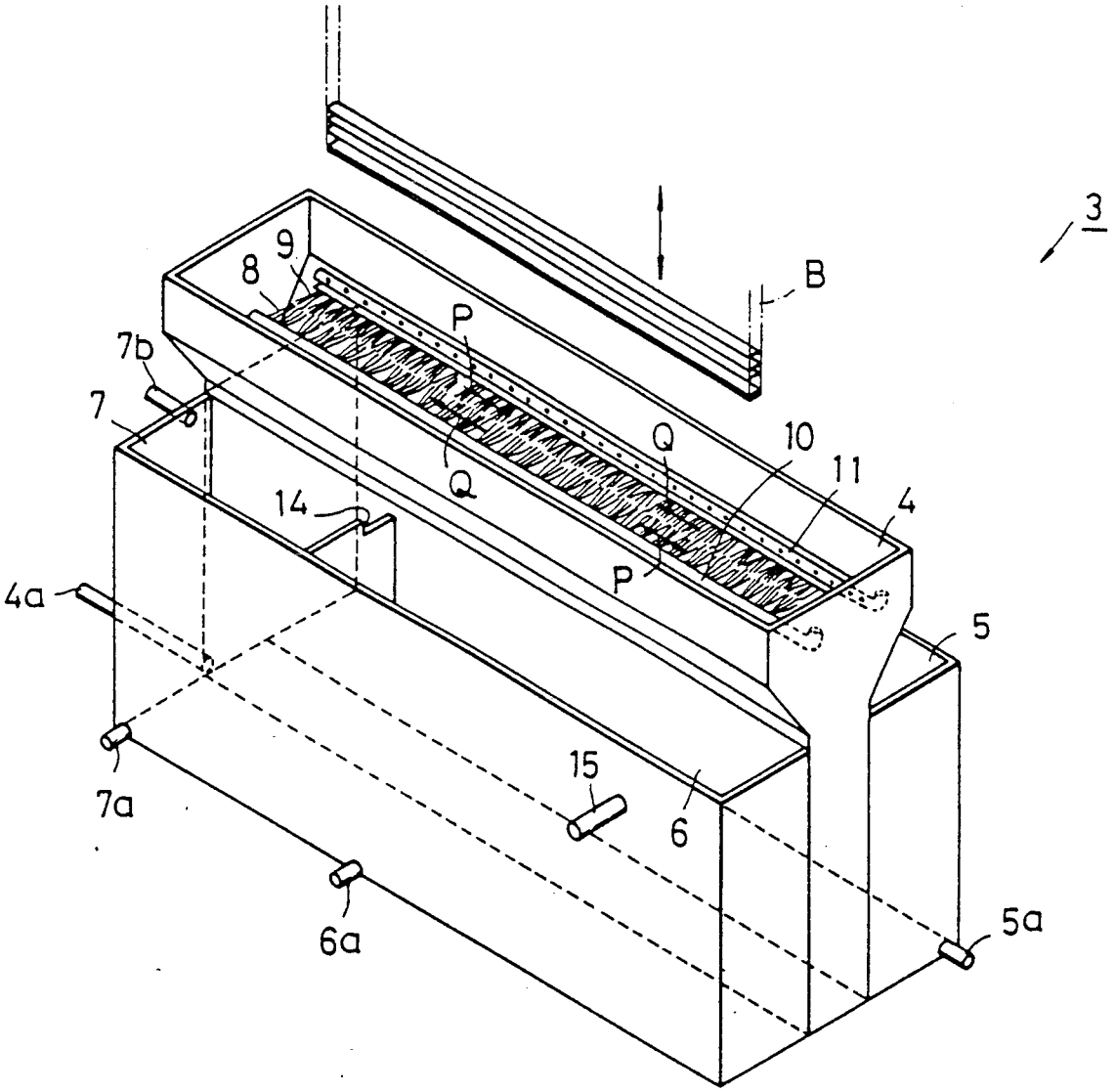
FIG. 2 is a perspective view of the blind washing apparatus according to the embodiment illustrated in FIG. 1.

In FIGS. 1 and 2 showing a first embodiment of a blind washing apparatus according to the invention, the blind washing apparatus 1 comprises a blind support device 2 and a blind washing section 3.

The blind washing apparatus 1 of this type is so constructed as to have a large capacity and uncomplicated in construction so that the apparatus can be used where contamination of a blind B to be washed is particularly substantial and the case where the blind B is to be washed particularly delicate. To this end, washing liquid is divided into detergent liquid, washing water for rough rinsing, and new water for finishing and, correspondingly, washing is carried out in three stages.

The arrangement of the apparatus according to the embodiment will be described below. The blind support device 2 is so arranged as to support the blind B by a support arm 2*a* whereby the blind is suspended therefrom in a fully developed or extended configuration and to reciprocate the support arm 2*a* vertically between a solid line position and a double-dotted line position as illustrated in FIG. 1 thereby moving the blind B vertically at a suitable cycle. Suspension of the blind B by the support arm 2*a* is carried out by supporting an upper frame of the blind by suitable gripping members. In the embodiment, however, the right and left ends of the upper frame B1 of the blind are supported by the use of respective O-rings 2*c*, 2*c*. In this connection, the arrangement may be such that the support arm 2*a* is not movable, but the blind B is moved vertically by wires or the like suspending the blind B.

The blind washing section 3 comprises a central washing tank 4 having a width and a size sufficient to accommodate the blind B when the support arm 2*a* of the blind support device 2 is in the double-dotted position, that is, in a position where the blind B is lowered, a second tank 5 arranged in front of and adjacent the washing tank 4 for storing detergent liquid of the washing liquid, a third tank 6 arranged in rear of and adjacent the washing tank 4 for storing washing water for rough rinsing, and a fourth tank 7 (see FIG. 2) for storing new water for finishing rinsing.

A pair of opposed washing brushes 8, 9 are arranged in rows at a location within the washing tank 4 and in the vicinity of an upper end of the washing tank 4 so as to clamp the blind B from both the front and back sides thereof substantially along the longitudinal direction. These washing brushes 8, 9 are so designed as to be reciprocated horizontally by well-known drive means, not shown, as indicated by the arrows P and Q in their respective directions opposite to each other along the longitudinal direction. Further, pipes 10, 11 have nozzles for injecting the washing water or the like onto each blade of the blind B and the washing brushes 8, 9, the nozzles being arranged in parallel relation to each other along the upper sides of the respective washing brushes 8, 9. These washing brushes and nozzles are located above the level of the washing liquid. Of these washing brushes and nozzles, the washing brushes 8, 9 may be arranged at a location immersed in the washing liquid.

Furthermore, arranged within the washing tank 4 are level sensors 12, 13 for detecting upper and lower water levels or liquid levels. The level sensors 12, 13 are electrically connected to a control unit to be described later, to perform detection of the water level or liquid level at each operation stage.

Moreover, openings 4*a*, 5*a*, 6*a* and 7*a* for feeding and discharging the detergent liquid, the washing water or the new water are provided respectively in the vicinity of bottoms of one sides of the respective washing tank 4 and second, third and fourth tanks 5, 6, 7. A feed water port 7*b* connected to a feed water source, not shown, is provided in the vicinity of an upper end of the fourth tank 7. Further, an overflow portion 14 is provided in a partition plate between the third and fourth tanks 6 and 7. An overflow pipe 15 is provided at the third tank 6 at a level lower than the overflow portion 14.

Figure 3:
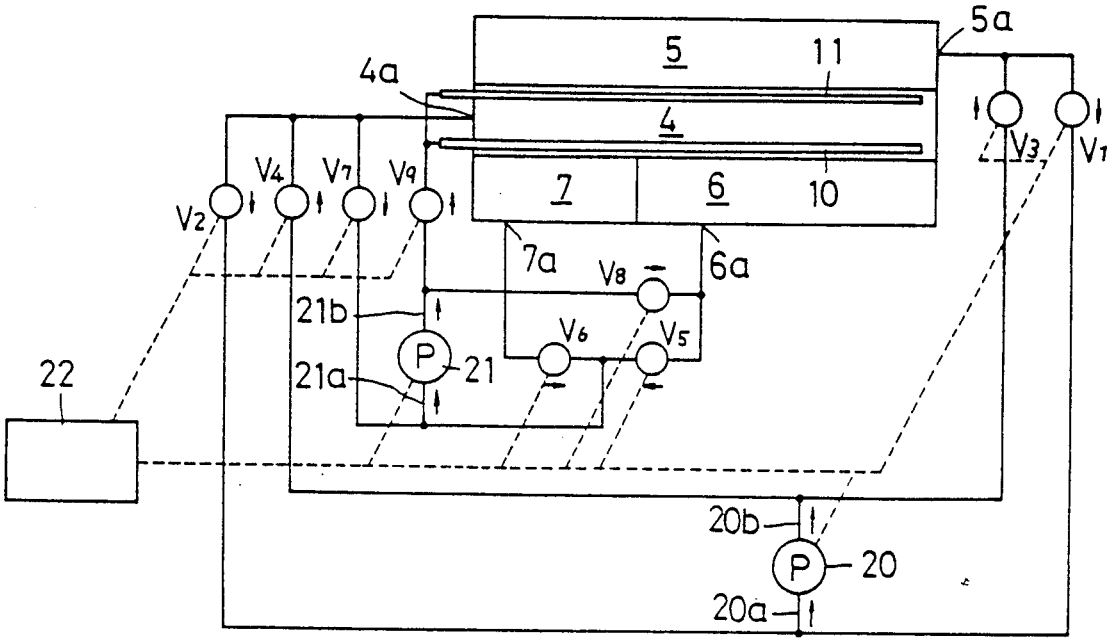
FIG. 3 is a circuit diagram of the embodiment illustrated in FIG. 1.

FIG. 3 shows a circuit diagram for the detergent liquid, the washing water and the new water of the washing liquid in the blind washing apparatus 1 illustrated in FIG. 1. The reference numeral 20 denotes a first pump for the detergent liquid. A suction side 20*a* of the first pump 20 is connected to the opening 5*a* of the second tank 5 through a valve V1, and to the opening 4*a* of the washing tank 4 through a valve V2. On the other hand, a delivery side 20*b* of the first pump 20 is connected to the opening 5*a* of the second tank 5 through a valve V3, and to the opening 4*a* of the washing tank 4 through a valve V4.

The reference numeral 21 denotes a second pump for the washing water and the new water. A suction side 21*a* of the second pump 21 is connected to the opening 6*a* of the third tank 6 through a valve V5, to the opening 7*a* of the fourth tank 7 through a valve V6, and to the opening 4*a* of the washing tank 4 through a valve V7. On the other hand, a delivery side 21*b* of the second pump 21 is connected to the opening 6*a* of the third tank 6 through a valve V8, and to the pipes 10 and 11 having nozzles, through a valve V9. The reference numeral 22 denotes a control unit for controlling operation of the first pump 20 for the detergent liquid and the second pump 21 for the washing water and the new water, and controls opening and closing of the valves V1 through V9. The control unit 22 executes control on the basis of a program which can suitably be modified.

The embodiment of the invention is constructed as above, and the operation of the embodiment will next be described in the order of washing operation steps.

(A) At a preparatory stage before washing of the blind B is carried out, the washing tank 4 is empty, the second tank is filled with the detergent liquid of the washing liquid, the third tank 6 is filled with the washing water for rough rinsing of the washing liquid, and the fourth tank 7 is filled with the new water for finishing of the washing liquid. With regard to the valves, the valves V1, V3, V5 and V8 are opened, while the remaining valves are closed. Accordingly, the pumps 20 and 21 form their respective closed loops with respect to the respective second tank 5 and third tank 6. Here, the blind B is attached to the support arm 2*a* of the blind support device 2, whereby the preparation is completed.

(B) Subsequently, when washing of the blind B is started, the valve V3 is closed and the valve V4 is opened under the control of the control unit 22, so that the detergent liquid within the second tank 5 is delivered into the washing tank 4 through the opening 5*a*, the valve V1, the pump 20, the valve V4 and the opening 4*a*. When the liquid level of the detergent liquid within the washing tank 4 reaches a predetermined level, this is detected by the level sensor 12. Again under the control of the control unit 22, the valve V3 is opened and the valve V4 is closed, so that delivery of the detergent liquid is terminated.

(C) Subsequently, the support arm 2*a* of the blind support apparatus 2 is reciprocated vertically by the drive unit 2*b*, whereby the blind B is lowered and dipped into the detergent liquid within the washing tank 4 and is then raised. This motion is repeated continuously for a predetermined period of time. During the motion, the washing brushes 8, 9 are reciprocated horizontally in their respective directions opposite to each other along the longitudinal direction, that is, in their respective directions indicated by arrows P and Q in FIG. 2, while clamping the vertically reciprocating blind B from both its front and back sides. The washing brushes 8, 9 brush each blade surface of the blind B to carry out washing of the blind B. It is to be noted here that since the washing brushes 8, 9 are reciprocated horizontally in their respective directions opposite to each other, the shaking of the blind B does not occur during the brushing. Since the blade surface has already been immersed in the detergent liquid within the washing tank 4, the dust, nicotine and the like adhered to the surface are removed by the brushing.

(D) Subsequently, the valve V1 is closed and the valve V2 is opened under the control of the control unit 22, so that the detergent liquid within the washing tank 4 is returned to the second tank 5 through the opening 4*a*, the valve V2, the pump 20, the valve V3 and the opening 5*a*. When the washing tank 4 is emptied of the detergent liquid, this is detected by the level sensor 13. Again under the control of the control unit 22, the valve V1 is opened and the valve V2 is closed, so that returning of the detergent liquid is completed.

(E) Simultaneously with the opening of the valve V1 and the closing of the valve V2 in the above (D), the valves V7 and V9 are opened and the valve V8 is closed under the control of the control unit 22. The washing water within the third tank 6 is delivered to the pipes 10, 11 within the washing tank 4, through the opening 6*a*, the valve V5, the pump 21 and the valve V9, and is injected through the nozzles in the pipes 10, 11. The washing water accumulated at the bottom of the washing tank 4 due to the injection of the washing water is delivered to the nozzles through the opening 4*a*, the valve V7 and the pump 21 and is again injected through the nozzles. Thus, rough rinsing of the blind B is performed.

(F) When a predetermined period of time elapses, the valves V5 and V7 are closed and the valve V6 is opened under the control of the control unit 22. The new water within the fourth tank 7 is delivered to the pipes 10, 11 within the washing tank 4, through the opening 7a, the valve V6, the pump 21 and the valve V9, and is injected through the nozzles. Thus, finishing rinsing of the blind B is carried out.

(G) When a predetermined period of time again elapses, the valves V6 and V9 are closed and the valves V7 and V8 are opened under the control of the control unit 22. The washing water and the new water accumulated within the washing tank 4 are delivered into the third tank 6 through the opening 4a, the valve V7, the pump 21, the valve V8, and the opening 6a. When the washing tank 4 is emptied of the washing water and the new water, this is detected by the level sensor 13, so that again under the control of the control unit 22, the valve V5 is opened and the valve V7 is closed, and the operation is returned to the initial stage (A). By doing so, a plurality of blinds can be washed continuously.

In connection with the above, the vertical reciprocative movement of the blind B, that is, the vertical (extending and contracting) movement of the support arm 2a, and the horizontal reciprocative movement of the washing brushes 8, 9 run on continuously from the washing stage of the above (C) to the finishing-rinsing stage of the above (F). Further, the first and second pumps 21, 21 are operated continuously. However, they may be stopped when the closed loops are formed, that is, when the detergent liquid, the washing water and the new water are not fed and discharged between the tanks.

The fourth tank 7 for storing the new water is supplemented with new water through the feed water port 7b and is always fully filled with water. The new water flows from the fourth tank 7 to the adjacent third tank 6 for storing the washing water, through the overflow portion 14. On the other hand, since waste water is discharged through the overflow pipe 15 of the third tank 6, the washing water contaminated due to the rough rinsing of the blind B is always maintained at a substantially constant, low contamination level. Thus, the rough rinsing of the blind B is carried out effectively.

As described above, the arrangement of the apparatus according to the embodiment is such that the washing liquid is separated into three applications including the detergent liquid, the washing water and the new water, and the washing of the blind is carried out at three stages. With such arrangement, the apparatus is suitable for such a case as to wash an exceedingly contaminated blind or a blind requiring particularly delicate washing, though the apparatus is made large in size. It is extremely preferable from the viewpoint of reduction in the cost and preservation of the environment, to arrange the apparatus in such a manner that the washing liquid having been once used to wash the blind can be collected and re-used. Further, if rinsing of the washed blind is carried out with the rinsing divided into the rough rinsing and the finishing rinsing, there are provided such advantages that the quantity of water required for the rinsing is reduced, and so on.

Figure 4:
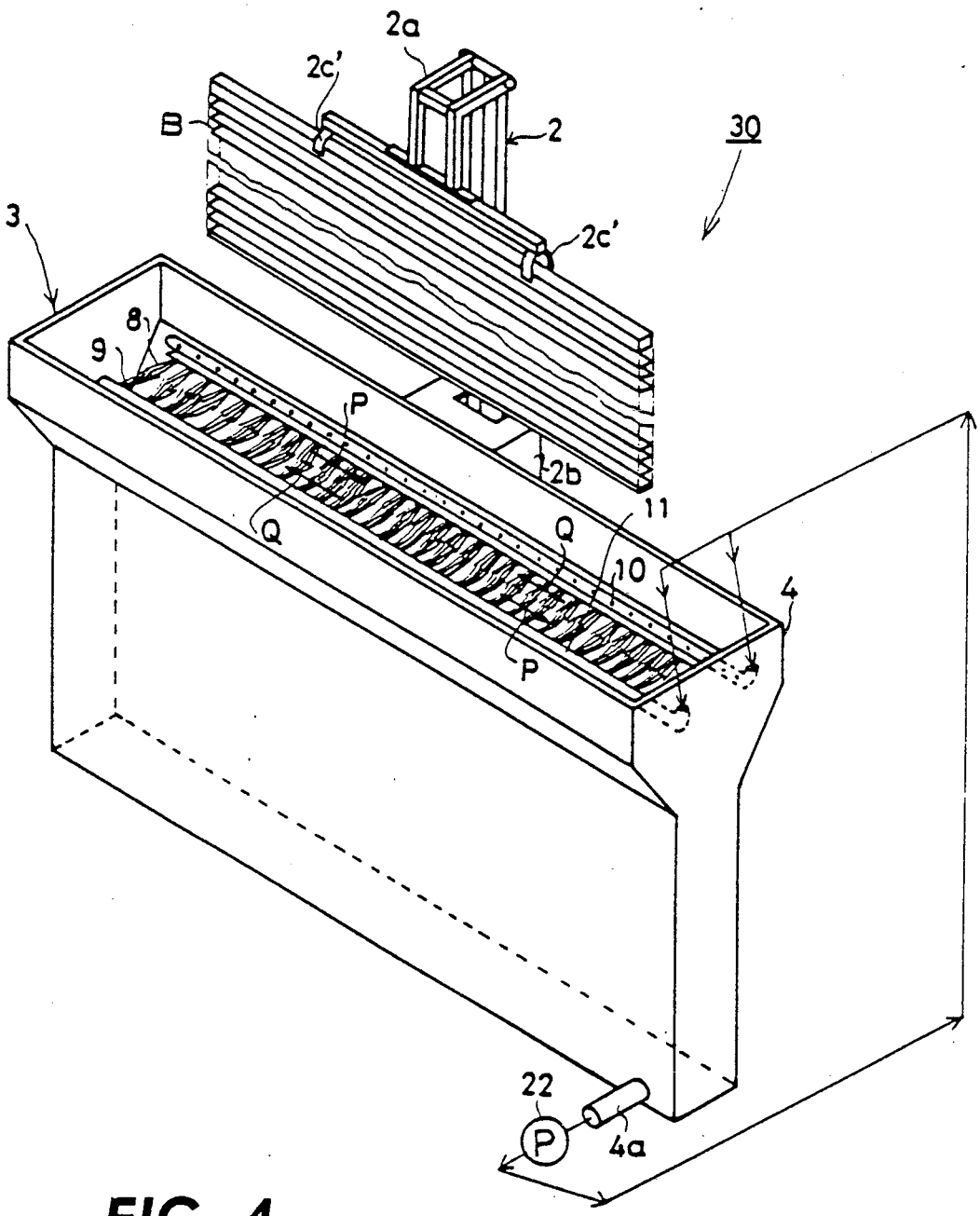
FIGS. 4 and 5 are a perspective view and a partial cross-sectional side elevational view, respectively, of a blind washing apparatus according to a second embodiment.
Figure 5:
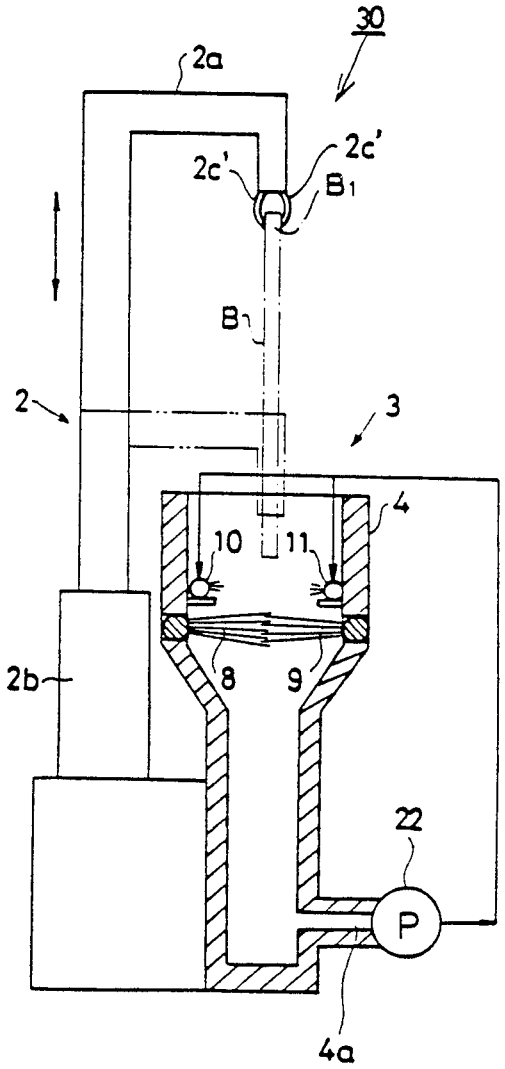

A second embodiment of the invention will next be described with reference to FIGS. 4 and 5.

A blind washing apparatus 30 according to this embodiment comprises a blind support device 2 similar to that of the previous embodiment. In the apparatus 30, however, suspension of the blind B is such that the right and left of an upper frame $B_1$ are gripped respectively by two clamp claws 2c', 2c'. Further, a blind washing section 3 is formed by a single washing tank 4, a pair of washing brushes 8, 9 arranged within the washing tank 4 at a location adjacent an upper end thereof, and pipes 10, 11 having nozzles arranged along the upper sides of the washing brushes 8, 9. These pipes 10, 11 are connected to an outlet port 4a formed adjacent a lower end of the washing tank 4, through a pump 22. During washing operation, washing liquid within the washing tank 4 is delivered by the pump 22 and is injected through the nozzles.

The apparatus according to this embodiment is simplified in construction as compared with the apparatus of the previous embodiment. Since the washing liquid is used in such a manner as to be recirculated between the washing tank 4 and the nozzles, the washing liquid is economized much more so that the apparatus is suitable for a case where contamination of the blind is not great.

Figure 6:
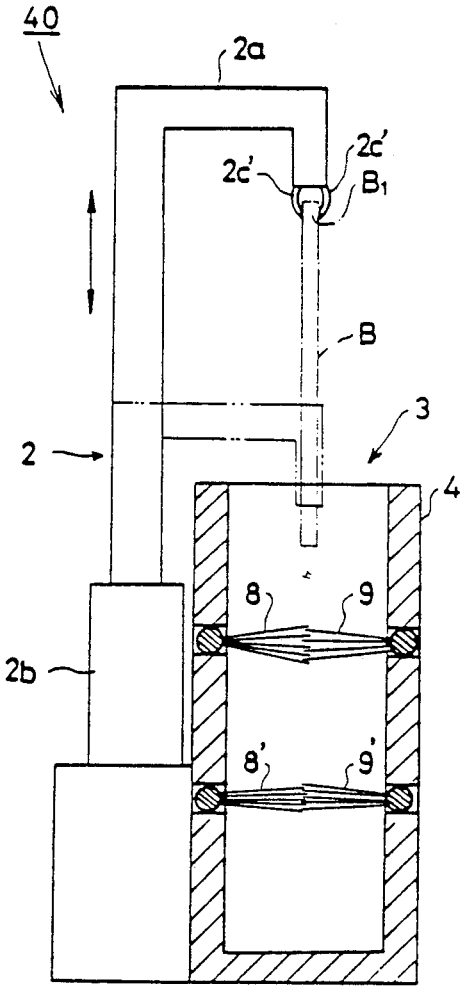
FIG. 6 is a side cross-sectional view showing a third embodiment of the invention.

FIG. 6 is a cross-sectional side elevational view showing a third embodiment in which the apparatus according to the second embodiment is more simplified.

In a blind washing apparatus 40 of this embodiment, a blind support device 2 is the same as that of the second embodiment, but the nozzles for injection of the washing liquid are not used. In place of the nozzles, two sets of washing brushes 8, 9 and 8', 9' are arranged within the washing tank 4 in an upper and lower two stage fashion, and are driven by a common drive source, not shown. The washing brushes in each set are reciprocated horizontally in their respective directions opposite to each other along a longitudinal direction of the washing tank 4. By doing so, contamination adhered to each blade surface of the blind can be swept away more efficiently by the two sets of washing brushes. In this connection, will be appreciated that these washing brushes may be arranged in a two or more, multi-stage manner.

Detergent liquid, new water or the like should properly be used, depending upon a contamination degree or the like, as the washing liquid employed in the above-described second and third embodiments.

The above-mentioned apparatus of the first embodiment is more suitable chiefly as a fixed type, whereas the apparatus of these second and third embodiments is suitable as a portable type in that the apparatus is loaded on, for example, a vehicle and can easily be used at any location.

In connection with the above, it is needless to say that the blind washing device 3 of the blind washing apparatus 40 according to the third embodiment may be used in combination with the apparatus of the first or second embodiment.

Figure 7:
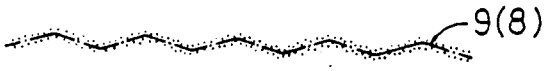
FIG. 7 is a fragmentary front elevational view showing an example of an arrangement of a washing brush.

The washing brushes 8, 9 are formed of sufficiently soft material, so that the blades are not damaged during the vertical reciprocative movement of the blind B. More preferably, when viewed in front elevation, the washing brushes 8, 9 are slightly corrugated along the longitudinal direction as shown in FIG. 7. By doing so, the entire brushes 8, 9 are not simultaneously brought into contact with the blades of the blind B particularly when the blind B is lowered. Accordingly, the blades are prevented from being pushed up, so that washing of the blind B is carried out reliably. In this connection, it is possible to optionally set the attaching positions of these brushes 8, 9 or 8', 9' within the washing tank and the number of the brushes. Further, it is more preferable to set the brushes in such a manner that their respective tips opposed to each other are brought into contact with each other, because the blind can be washed completely up to the corners of each blade.

Figure 8:
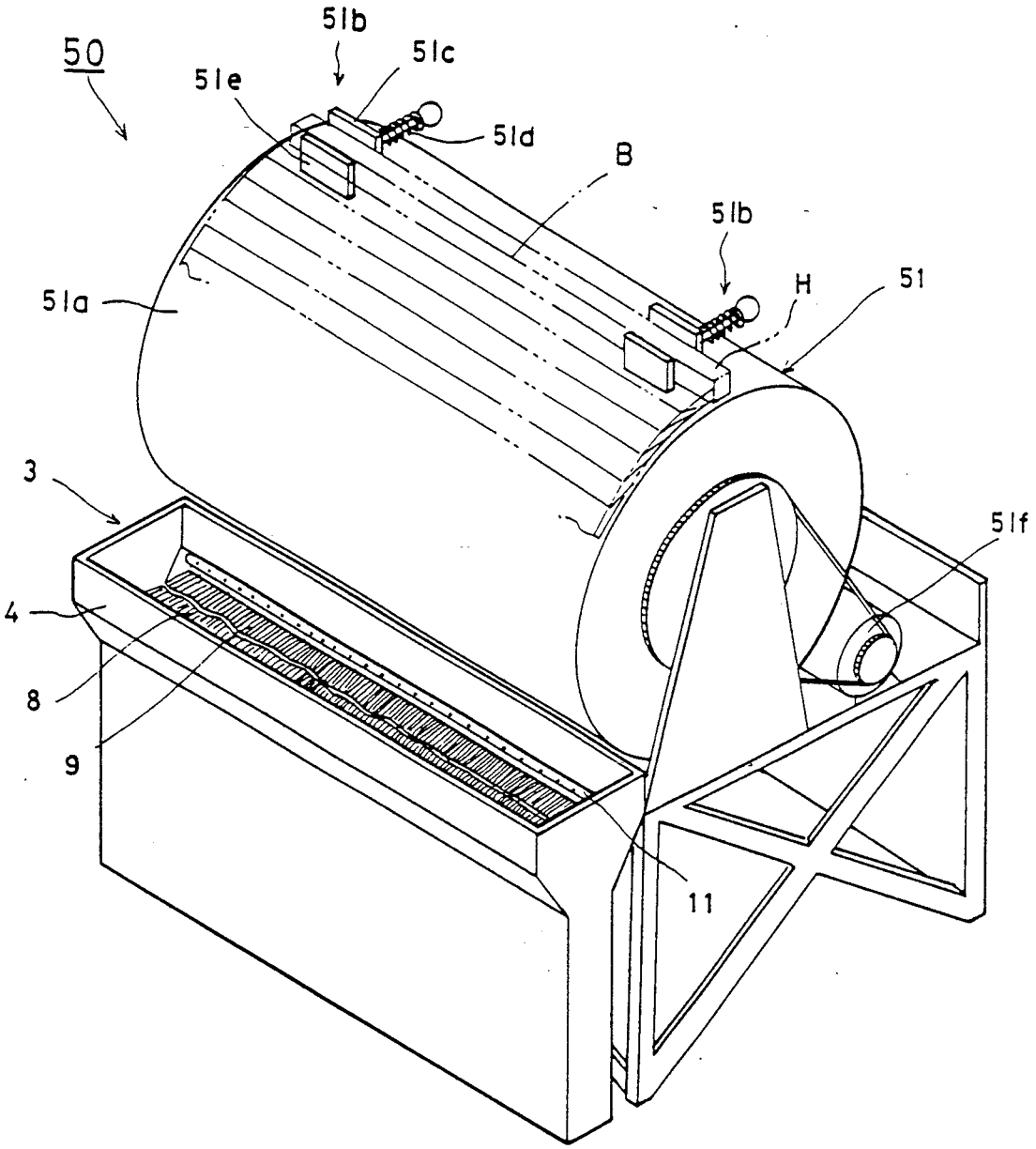
FIG. 8 is a diagrammatic perspective view showing another example of a blind support device.
Figure 9:
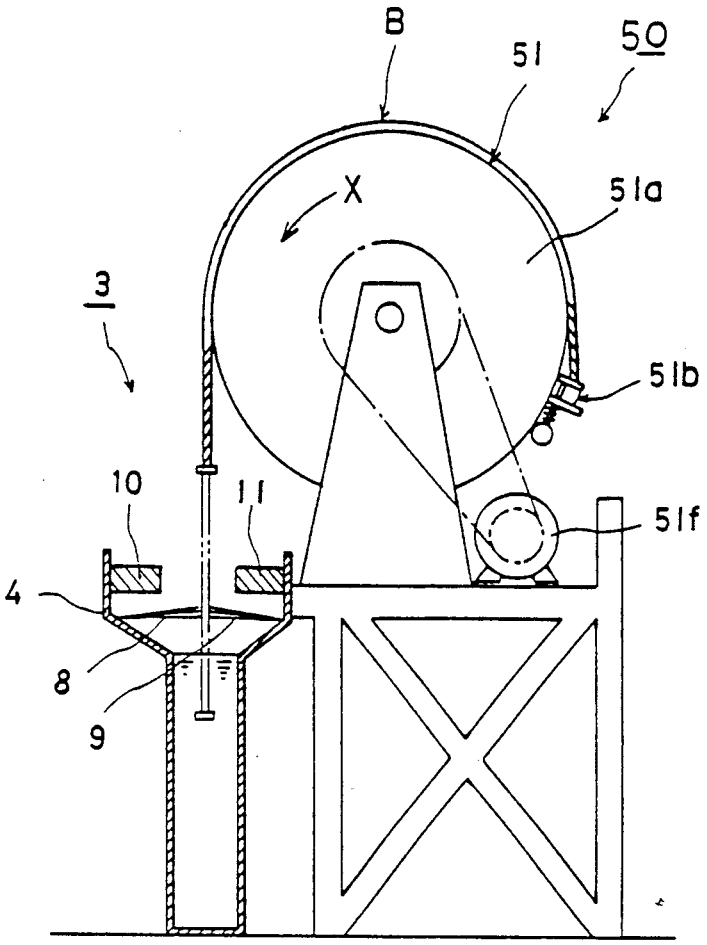
FIG. 9 is a partial cross-sectional diagrammatic side elevational view of FIG. 8.
Figure 10:
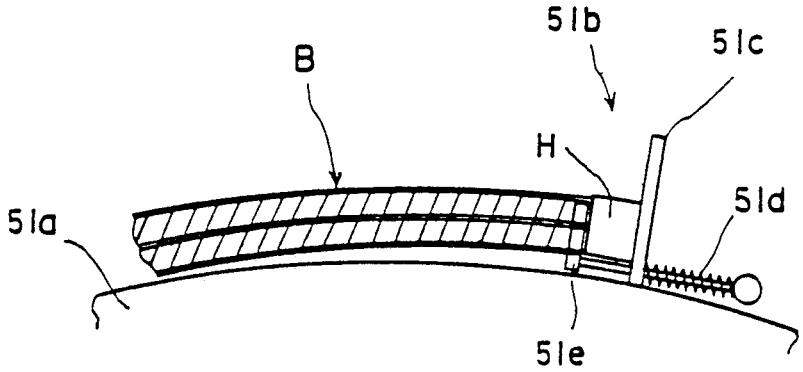
FIG. 10 is a view showing a hook unit of a rotary drum illustrated in FIG. 8.

FIGS. 8 through 10 show another embodiment of the invention in which a blind washing apparatus 50 comprises a blind support device 51 in the form of a drum.

This blind support device 51 is arranged on one side of the washing tank 4, and is composed of a rotary drum 51*a* formed of, for example, plastic material having a central shaft extending in the longitudinal direction of the washing tank 4. The rotary drum 51*a* is provided on its cylindrical surface with hook units 51*b* for retaining a head box of the blind B. As shown in FIG. 10, each hook unit 51*b* is provided with a latching plate 51*e* which is biased under the action of a compression spring 51*d* against a base plate 51*c* in the form a plate projecting radially from the surface of the rotary drum 51*a*. The head box H of the blind B is clamped between the base plate 51*c* and the latching plate 51*e* so that the head box is fixedly retained. Thus, the blind support device 51 supports the blind B in such a manner that the head box H of the blind B is retained by the hook units 51*b*, and the blind B is wound along the cylindrical surface of the rotary drum 51*a* with the blind developed. The rotary drum 51*a* is moved angularly about its central shaft by a drive unit 51*f*, whereby the blind B is reciprocated vertically between a solid position and a double-dotted position at a region on one side of the rotary drum 51*a* to move the blind B vertically at a suitable cycle.

In connection with the above, the drive unit 51*f* is so arranged that rotational torque due to, for example, a motor capable of being rotated in normal and reverse directions is transmitted to the rotary drum 51*a* through a transmission mechanism such as, for example, a belt, gears, a chain or the like. It is needless to say, however, that rotational torque from a motor rotating only in one direction may be switched by gears.

Further, a grip portion, for example, may be mounted to the central shaft of the rotary drum 51*a* thereby rotatively driving the rotary drum manually without the use of the above-mentioned drive unit 51.

In connection with the above, if the surface of the rotary drum 51 is formed into a lattice-like or any other suitable structure having gaps, draining can be effected simultaneously when the blind B is wound up after washing. Further, if a dryer or the like is arranged within or adjacent the rotary drum 51*a*, it is possible to carry out drying of the blind B after washing more quickly.

The arrangement of the blind washing apparatus 50 of this embodiment is such that the blind is wound around the rotary drum 51*a* with the blind developed thereby supporting the blind, and the rotary drum 51*a* is moved angularly thereby reciprocating the blind vertically on one side of the rotary drum. With such arrangement, it is possible to arrange the blind support device 51 so as to bring its overall height to a relatively low level.

Further, since the blind is supported by the entire cylindrical surface of the rotary drum, the strength of the rotary drum per se may be low relatively, so that the rotary drum can be formed of, for example, plastic material. Moreover, if the surface structure of the rotary drum is formed into a lattice-like shape having suitable gaps, it is possible to effect draining simultaneously with winding-up of the blind.

Thus, according to this embodiment, there is provided the blind washing apparatus in which the apparatus is so arranged as to have its relatively low overall height, whereby the installation space is made small relatively and the apparatus can easily be carried at the movement thereof.

Figure 11:
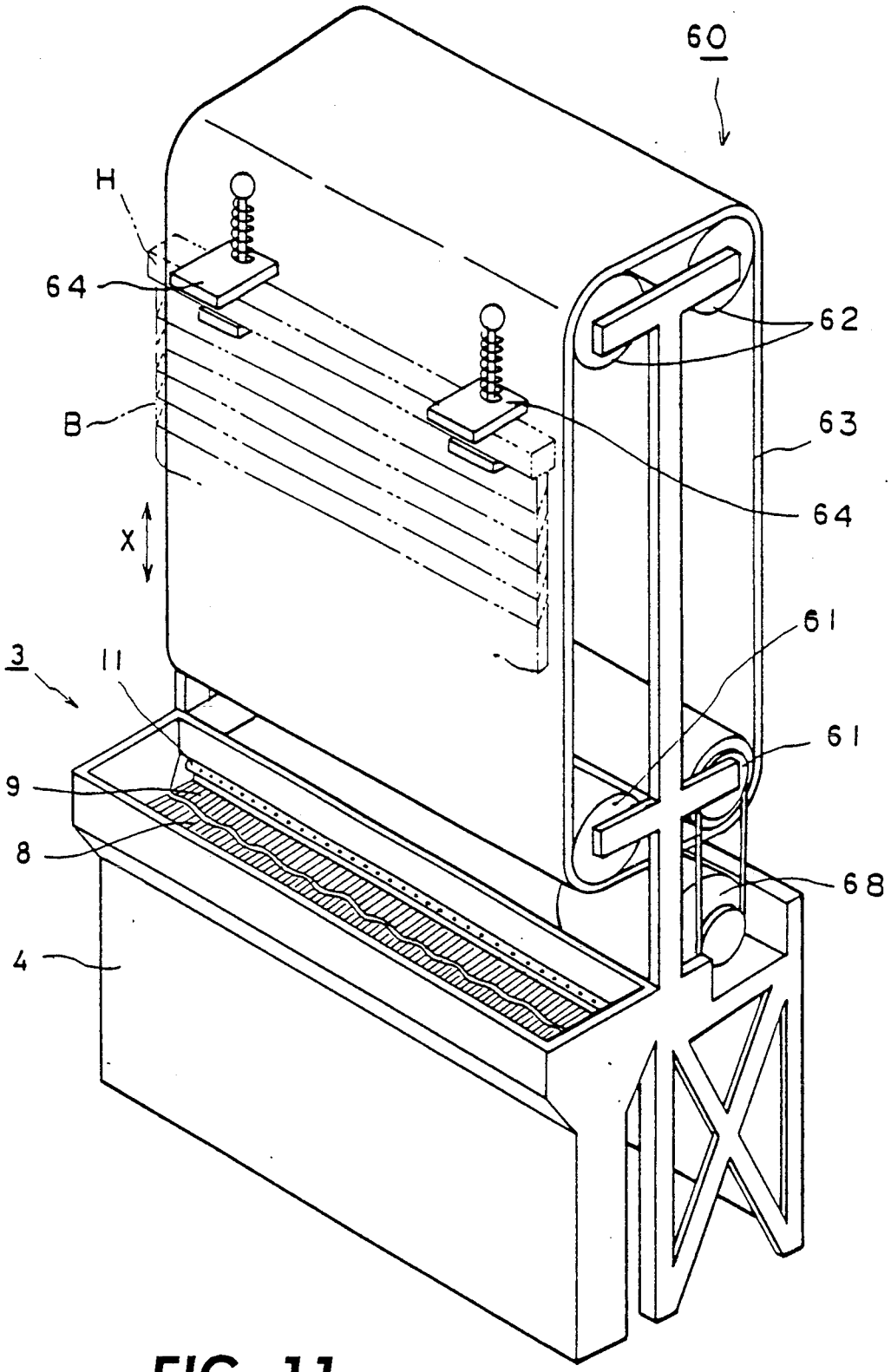
FIG. 11 is a diagrammatic perspective view showing still another embodiment of the blind support device.
Figure 12:
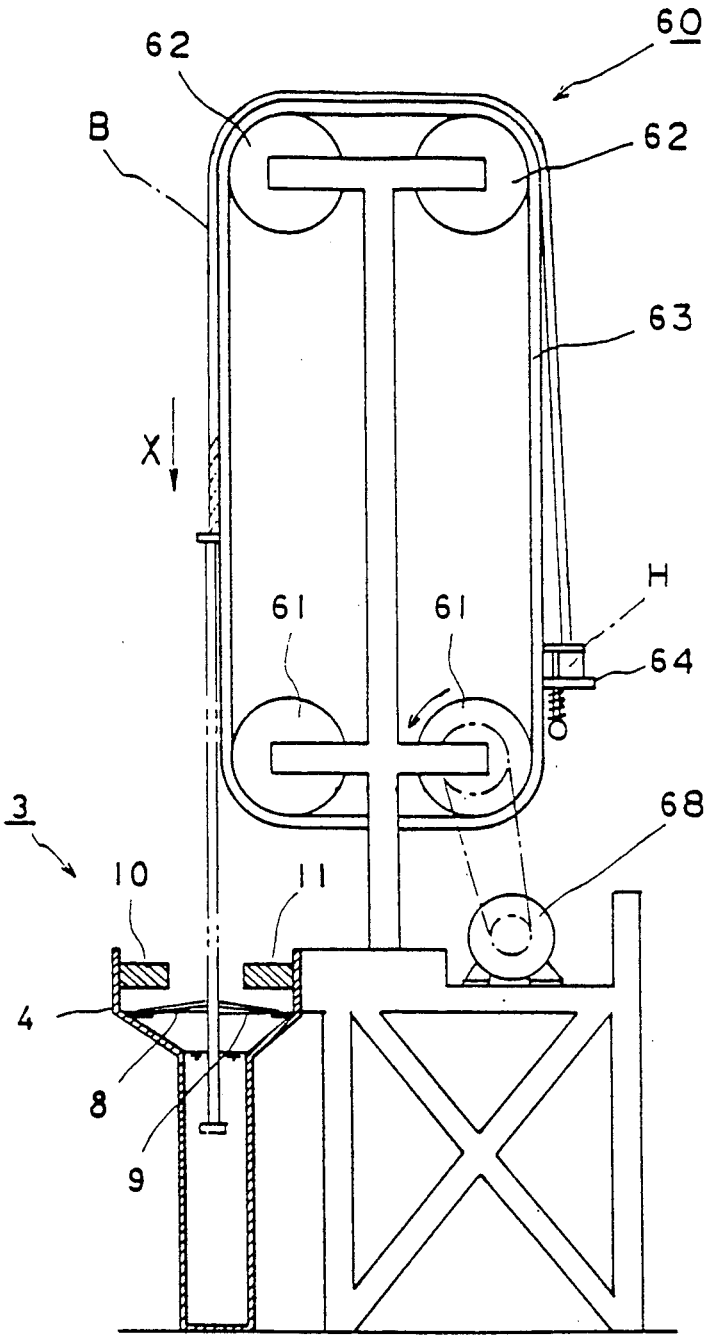
FIG. 12 is a partial cross-sectional diagrammatic side elevational view of FIG. 11.
Figure 13:
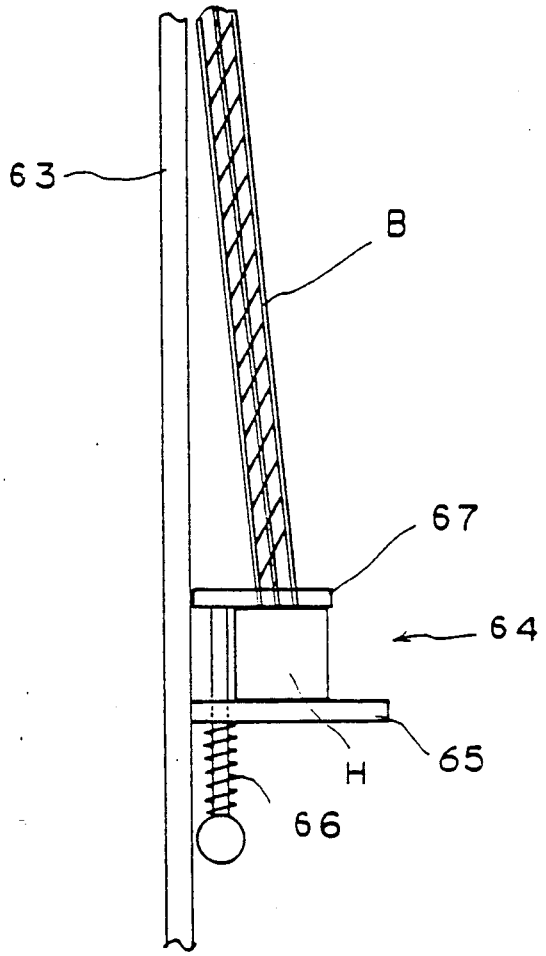
FIG. 13 is a view showing a hook unit of a belt conveyor illustrated in FIG. 11.

FIGS. 11 and 12 show still another embodiment of the invention in which a blind washing apparatus 60 is composed of a belt conveyor 63 running about parallel rotary shafts 61, 62 (four rotary shafts in case of the illustrated embodiment) extending in the longitudinal direction, in place of the aforementioned drum-like blind support device 51. Hook units 64 for retaining the head box H of the blind are arranged on the belt surface. As shown in FIG. 13, each hook unit 64 is provided with a latching plate 67 biased under the action of a compression spring 66 against a base plate 65 in the form of a plate projecting radially from the surface of the belt conveyor 63. The head box H of the blind is clamped and fixed between the base plate 65 and the latching plate 67. Thus, by angularly moving one of the rotary shafts 61, 62 by a drive unit 68, the blind B supported by the belt conveyor 63 is moved vertically in a direction X at a suitable cycle.

According also to this embodiment, the overall height of the blind support device can be made low similarly to the previous embodiment. Thus, the apparatus is convenient for loading on a vehicle and for carrying.

Figure 14:
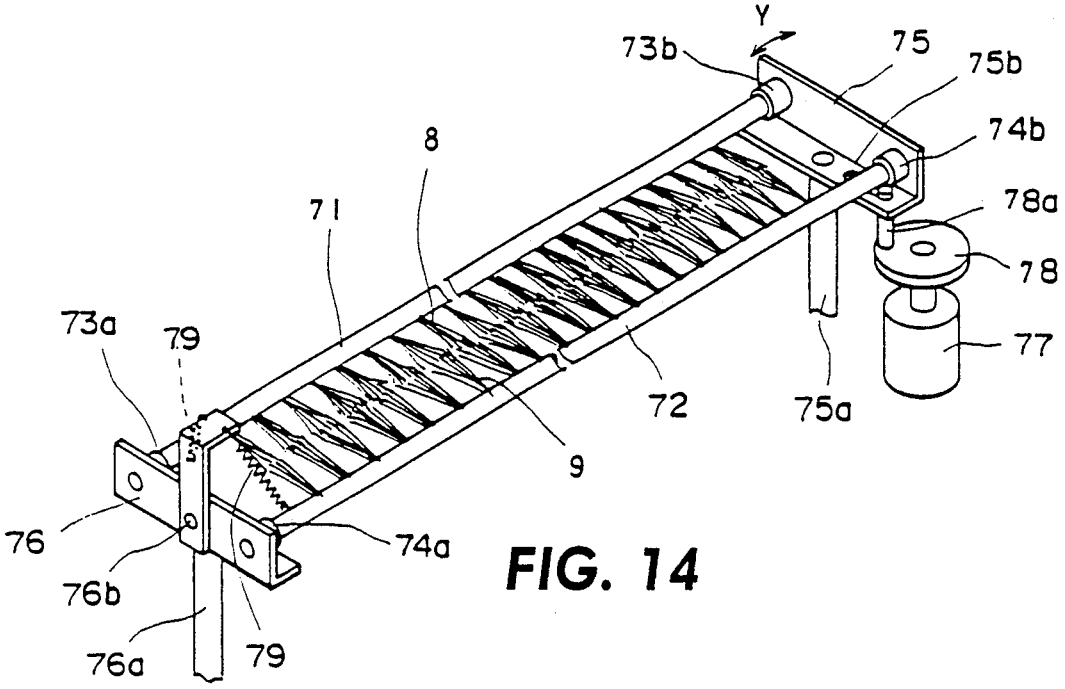
FIG. 14 is a diagrammatic perspective view showing an example of a drive mechanism for the washing brushes.
Figure 15:
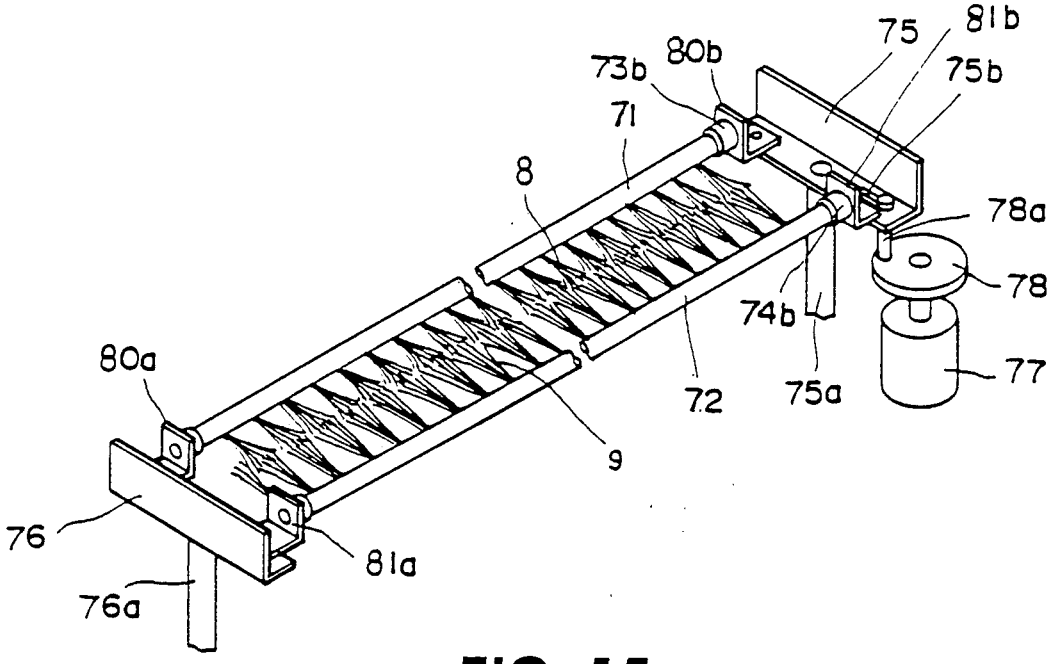
FIG. 15 is a diagrammatic perspective view showing a modification of FIG. 14.

An example of a washing-brush drive mechanism of the blind washing apparatus according to the invention will next be described. As shown in FIGS. 14 and 15, the washing brushes 8, 9 are mounted respectively to washing-brush support members 71, 72. The support members 71, 72 are connected to each other at their opposite ends respectively by connecting members 75, 76 through universal joints 73*a*, 73*b* and 74*a*, 74*b* such as, for example, link-ball bearings or the like pivotally movable freely in any direction, thereby forming a parallelogram.

It is to be noted here that one connecting member 75 is pivotally supported at its central section for angular movement about a vertical shaft 75*a*, and is provided with a longitudinally extending slit 75*b*. Fitted in the slit 75*b* is a pin 78*a* mounted eccentrically to a rotary disc 78 which is rotatively driven by a motor 77.

Thus, rotation of the motor 77 causes the rotary disc 78 to be driven rotatively, whereby the connecting member 75 is swung while describing an arc as indicated by an arrow Y. Accordingly, the washing brushes 8, 9 are reciprocated arcuately in their respective directions opposite to each other substantially along the longitudinal direction while being maintained parallel to each other, and the washing brushes 8, 9 repeat movement toward and away from each other.

The other connecting member 76 is pivotally supported at its central section for angular movement about a vertical shaft 76*a*, and is pivotally supported for angular movement about a horizontal pivot 76*b* extending in the longitudinal direction of the washing brushes 8, 9. Further, the connecting member 76 has its opposite ends which are suspended from the above by means of springs 79 in such a manner that the connecting member 76 is normally maintained horizontal. Thus, the connecting member 76 can be swung horizontally substantially about the vertical shaft 76*a* similarly to the aforesaid one connecting member 75, and the opposite ends of the connecting member 76 can be swung vertically about the horizontal pivot 76*b*.

When the blind B is washed, the motor 77 is rotated to rotatively drive the rotary disc 78, so that the connecting member 75 is swung in the direction indicated by the arrow Y. The washing brushes 8, 9 are reciprocated in their respective directions opposite to each other substantially along the longitudinal direction so as to describe an arc, while clamping the vertically reciprocating blind B from its opposite sides, and the washing brushes 8, 9 repeat movement toward and away from each other. Thus, the brushes 8, 9 brush each blade surface of the blind B arcuately, thereby washing the blind B. In this case, the brushes 8, 9 move toward each other in the vicinity of the opposite ends of the swinging movement of the connecting member 75, so that the brushes 8, 9 are strongly abutted against the blades. Since the blades have already been immersed in the washing liquid within the washing tank 4, the brushing causes the dust and the like adhered to the blind surfaces to be removed therefrom. Further, since the brushes 8, 9 move away from each other in the vicinity of the middle of the swinging movement of the connecting member 75, the washing brushes 8, 9 are brought into light contact with the blades, so that the dust and the like removed from the blade surfaces in the manner described above are swept away and fall.

Moreover, even if the blade is caught by the washing brushes 8, 9 when the blind B descends, the caught blade is disengaged from the washing brushes, because the washing brushes 8, 9 move away from each other in the vicinity of the middle of the swinging movement of the connecting member 75. Thus, it is possible to prevent a plurality of blades from being superimposed one upon another. Furthermore, even if the washing blades 8, 9 are caught by the blade when the blind B ascends, the washing brushes 8, 9 ascend following ascending of the blades, because the washing brushes are merely suspended by the springs 79. Thus, the washing brushes 8, 9 are disengaged from the blade when the washing brushes move away from each other in the vicinity of the middle of the swinging movement of the connecting member 75, so that it is possible to prevent the blades from being damaged.

In connection with this embodiment, the washing-brush support members 71, 72 are suspended at their respective ends by the springs 79, but a central section may be suspended by a single spring.

FIG. 15 shows a modification of the embodiment illustrated in FIG. 14. The modification is similar in construction to the embodiment shown in FIG. 14 except that the washing brushes 8, 9 are pivotally supported for swinging movement about axes extending in the longitudinal direction of the washing brushes 8, 9 by universal joints **73*b* and 74*b* which in turn are mounted through cranks 80*a*, 80*b* and 81*a*, 81*b* for angular movement about respective vertical pivots. The operation of the modification is also similar to that of the embodiment illustrated in FIG. 14**.

In this case, the washing brushes 8, 9 are reciprocated arcuately substantially along the longitudinal direction by the swinging movement of the connecting member 75, whereby the washing brushes 8, 9 repeat movement toward and away from each other. Further, the tips of the respective washing brushes 8, 9 are swung up and down about pivoting axes of the respective cranks **80*a*, 80*b* and 81*a*, 81*b* pivotally supporting the washing-brush support members 71, 72. Thus, even if the washing brushes 8, 9 are caught by the blades when the blind B moves up and down, the washing brushes are disengaged from the blades when the washing brushes 8, 9** ascend or descend together with the blades and move away from each other.

Figure 16:
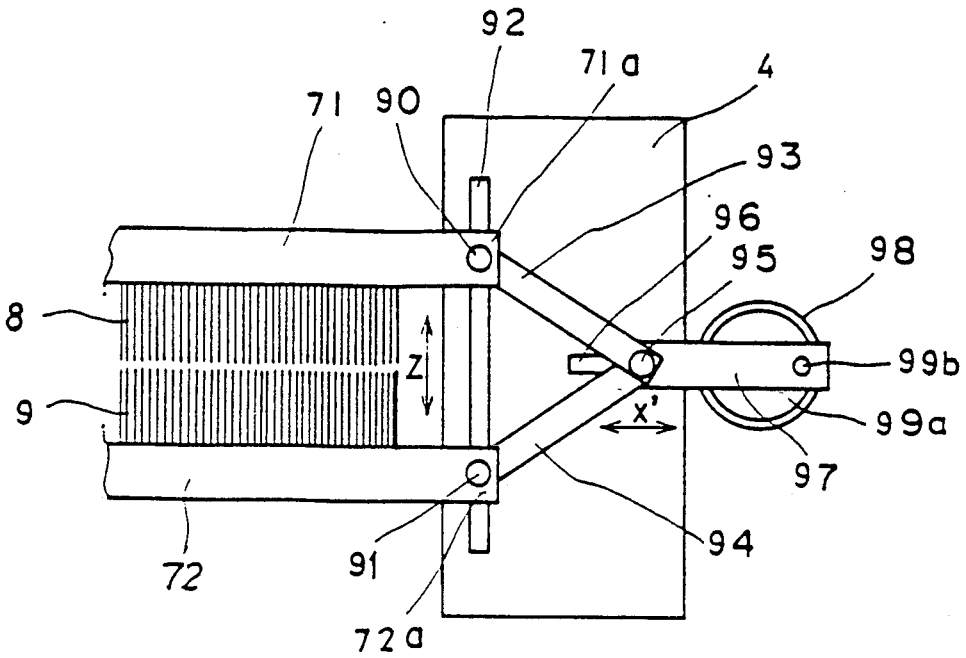
FIG. 16 is a fragmentary top plan view showing another example of the drive mechanism for the washing brushes.
Figure 17:
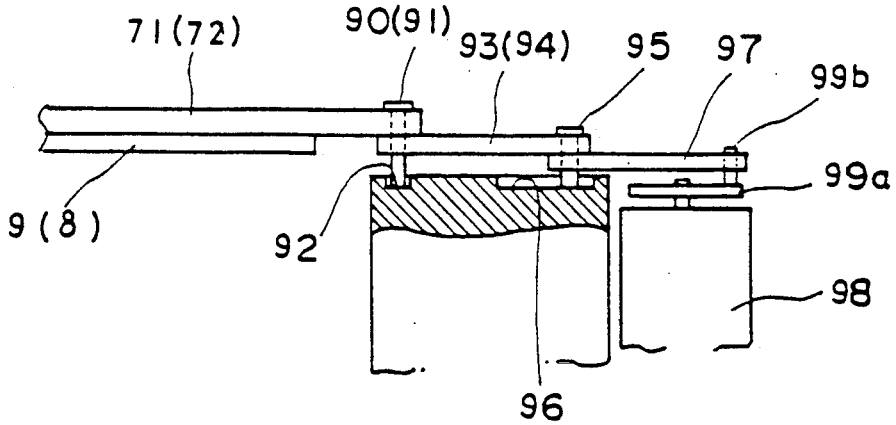
FIG. 17 is a partially cross-sectional side elevational view of FIG. 16.

FIGS. 16 and 17 show another example of the washing-brush drive mechanism of the blind washing apparatus according to the invention. The washing brushes 8, 9 are mounted respectively to the washing-brush support members 71, 72. The washing-brush support members 71, 72 are mounted to the washing tank 4 in such a manner that downwardly extending pins 90, 91 mounted respectively to one ends **71*a*, 72*a* of the washing-brush support members 71, 72 are engaged with a slide guide 92 fixedly arranged relatively to the washing tank 4. Thus, the washing-brush support members 71, 72 are supported for sliding movement along the slide guide 92** in the horizontal direction perpendicular to the longitudinal direction.

Connecting members 93, 94 equal in length to each other have their respective one ends which are pivotally connected respectively to the pins 90, 91 mounted to the one ends of the respective washing-brush support members 71, 72. The other ends of the respective connecting members 93, 94 extend outwardly substantially in the longitudinal direction of the washing-brush support members 71, 72, and are pivotally connected to a single pin 95 in a superimposed manner. This pin 95 is engaged with a slide guide 96 fixedly arranged relatively to the washing tank 4, whereby the pin 95 is supported for horizontal sliding movement along a longitudinal direction. A connecting member 97 has one end thereof pivotally connected to the pin 95. The other end of the connecting member 97 is pivotally connected to a pin **99*b* which is mounted eccentrically to a rotary disc 99*a* rotatively driven by a motor 98**.

Accordingly, the pin **99*b* moves in orbital motion by rotation of the motor 98, so that the pin 95 is reciprocated along the slide guide 96 in a direction indicated by an arrow X' by means of a crank mechanism formed by the connecting member 97**.

By doing so, when the connecting member 97 moves to the left as viewed in the figure, the pins 90, 91 slide away from each other along the slide guide 92 in a direction indicated by an arrow Z through the connecting members 93, 94. On the other hand, when the connecting member 97 moves to the right as viewed in the figure, the pins 90, 91 slide toward each other along the slide guide 92 through the connecting members 93, 94. Thus, the washing brushes 8, 9 are reciprocated so as to repeat movement toward and away from each other substantially perpendicularly (in the Z direction) to the longitudinal direction, while being maintained substantially parallel to each other.

In connection with the above, the other ends of the respective washing-brush support members 71, 72 may be pivotally supported respectively by vertical shafts merely for horizontal swinging movement. However, a mechanism identical with the above-mentioned reciprocating mechanism may be provided at the other ends of the washing-brush support members 71, 72. In this case, the arrangement is such that the respective reciprocating mechanisms at the opposite ends of the washing-brush support members 71, 72 are synchronized in motion with each other, whereby the washing-brush support members 71, 72 are always maintained parallel to each other.

In the above case, when the motor 98 is rotated to rotatively drive the rotary disc **99*a*, the pin 95 slides along the slide guide 96** in the X' direction, and the pins 90, 91 are reciprocated in the Z direction along the side guide 92. Thus, the washing brushes 8, 9 repeat movement toward and away from each other in such a manner that the washing brushes 8, 9 are reciprocated in their respective directions opposite to each other substantially perpendicularly to the longitudinal direction while clamping the vertically reciprocating blind B from its opposite sides. In this manner, the washing brushes 8, 9 brush each blade surface of the blind B, thereby carrying out washing of the blind B.

It is needless to say that, although several embodiments of the invention have been described, various modifications may be made to the invention within a scope without a departure from the spirits of the invention. For instance, the invention can easily be put into practice even by suitable combination of the above-mentioned various embodiments.

What is claimed is:

1. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind, said washing means including a first tank for containing a washing liquid, a second tank for containing a detergent liquid, means for transferring the detergent liquid from said second tank to said first tank upon initiation of washing and returning the detergent liquid to said second tank from said first tank upon termination of washing, and a pair of brushes mounted within said first tank, said pair of brushes extending in a corresponding longitudinal direction as said elongated blades and being arranged in opposed relation to each other, means for moving said blades in said extended position of said blind between said pair of brushes and between a first position wherein said blades are within said first tank and a second position wherein said blades are removed from said first tank;

means for supporting said blind in said extended position thereof and reciprocating said blind relative to said washing means between said first and second positions to enable said brushes and said washing liquid to wash said blades;

said washing means further including a third tank for storing washing water;

a plurality of nozzles arranged above and along said pair of brushes within said first tank and means for injecting washing water from said third tank through said plurality of nozzles to said blind when moved between said first and second positions;

said washing means further including a fourth tank for storing fresh water; and means for injecting the fresh water of said fourth tank through said plurality of nozzles to said blind when moved between said first and second positions.

2. An apparatus according to claim 1, wherein said pair of brushes are disposed adjacent an upper end of said first tank, said pair of brushes being reciprocated in respective opposite longitudinal directions.

3. An apparatus according to claim 1, wherein said first and second positions are vertically spaced from each other and said upper and lower elements of said blind extend substantially horizontally.

4. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind including a tank for containing a washing liquid and a pair of brushes mounted within said tank, said pair of brushes extending in a corresponding longitudinal direction as said elongated blades and being arranged in opposed relation to each other, means for moving said blades in said extended position of said blind between said pair of brushes and between a first position wherein said blades are within said tank and a second position wherein said blades are removed from said tank; and means for supporting said blind in said extended position and reciprocating said blind relative to said washing means between said first and second positions to enable said brushes and said washing liquid to wash said blades of said blind;

said pair of brushes being configured to be corrugated with reference to said longitudinal direction.

5. An apparatus according to claim 4, wherein said first and second positions are vertically spaced apart from each other and said upper and lower elements of said blind extend substantially horizontally.

6. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind including a tank for containing a washing liquid and a plurality of vertically spaced sets of brushes mounted within said tank, said plurality of sets of brushes extending in a corresponding longitudinal direction as said elongated blades, the brushes in each set having a pair of brushes disposed in opposition to each other along said longitudinal direction, means for moving said blades in said extended position of said blind between the pair of brushes of each of said plurality of sets of brushes and between a first position wherein said blades are within said tank and a second position wherein said blades are removed from said tank; and means for supporting said blind in said extended position and reciprocating said blind relative to said washing means between said first and second positions to enable said sets of brushes and said washing liquid to wash said blades.

7. An apparatus according to claim 6, wherein said first and second positions are vertically spaced apart from each other, and said upper and lower elements of said blind extend substantially horizontally.

8. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind, said washing means including a tank for containing a washing liquid and a pair of brushes mounted within said tank, said pair of brushes extending in a corresponding longitudinal direction as said elongated blades and being arranged in opposed relation to each other, means for moving said blades in said extended position of said blind between said pair of brushes and between a first position wherein said blades are within said tank and a second position wherein said blades are removed from said tank; and means for supporting said blind in said extended position and reciprocating said blind relative to said washing means between said first and second positions to enable said brushes and said washing liquid to wash said blades; and said support means comprising at least one upstanding support arm for supporting said blind in a suspended manner, and a drive unit for moving said support arm between said first and second positions defining a predetermined cycle of movement of said blind.

9. An apparatus according to claim 8, wherein said first and second positions are vertically spaced apart from each other, and said upper and lower elements of said blind extend substantially horizontally.

10. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind, said washing means including a tank for containing a washing liquid and a pair of brushes mounted within said tank, said pair of brushes extending in a corresponding longitudinal direction as said elongated blades and being arranged in opposed relation to each other, means for moving said blades in said extended position of said blind between said pair of brushes and between a first position wherein said blades are within said tank and a second position wherein said blades are removed from said tank means; and means for supporting said blind in said extended position and reciprocating said blind relative to said washing means between said first and second positions to enable said brushes and said washing liquid to wash said blades;

said support means comprising a cylindrical rotary drum having an axis extending parallel to said longitudinal direction, said rotary drum being rotatable about said axis and having a cylindrical surface located adjacent to said tank, said rotary drum having a hook for retaining said blind on said cylindrical surface of said rotary drum; and means for reciprocating said rotary drum about said axis to reciprocate said blind retained by said hook between said first and second positions.

11. An apparatus according to claim 10, wherein said rotary drum is formed of a plastic material, said cylindrical surface having a plurality of openings spaced apart from each other peripherally about said rotary drum.

12. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind including a tank for containing a washing liquid and a pair of brushes mounted within said tank, said pair of brushes extending in a corresponding longitudinal direction as said elongated blades and being arranged in opposed relation to each other, means for moving said blades in said extended position of said blind between said pair of brushes and between a first position wherein said blades are within said tank and a second position wherein said blades are removed from said tank; and means for supporting said blind in said extended position and reciprocating said blind relative to said washing means between said first and second positions to enable said brushes and said washing liquid to wash said blades;

said support means comprising a belt conveyor arranged adjacent said tank, and a pair of spaced rotary shafts extending in parallel relation to each other and extending substantially parallel to said longitudinal direction, said belt conveyor passing between and being wound about said pair of rotary shafts, said belt conveyor having at least one hook on its surface for retaining said blind; and said belt conveyor being wound about said pair of rotary shafts to reciprocate said blind between said first and second positions.

13. An apparatus according to claim 12, wherein said pair of rotary shafts are vertically spaced apart one from the other.

14. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind including a tank for containing a washing liquid and a pair of brushes mounted within said tank, said pair of brushes extending in a corresponding longitudinal direction as said elongated blades and being arranged in opposed relation to each other, means for moving said blades in said extended position of said blind between said pair of brushes and between a first position wherein said blades are within said tank and a second position wherein said blades are removed from said tank; and means for supporting said blind in said extended position and reciprocating said blind relative to said washing means between said first and second positions to enable said brushes and said washing liquid to wash said blades;

said pair of brushes being reciprocated in their respective directions opposite to each other arcuately substantially along said longitudinal direction;

said apparatus further comprising a pair of washing-brush supports for supporting said pair of brushes, respectively, a plurality of universal joint means, and a pair of first and second connecting means, said pair of washing-brush supports having respective one ends connected to each other by said first connecting means through ones of said plurality of universal joint means, while the other ends of the respective washing-brush supports are connected to each other by said second connecting means through the remaining universal joint means;

at least one of said first and second connecting means having its central section supported for angular movement about a central axis extending perpendicularly to said elongated direction; and said angular movement of said at least one connecting means about said central axis causing said pair of brushes to be reciprocated arcuately substantially along said longitudinal direction.

15. An apparatus according to claim 14, wherein said first and second positions are vertically spaced one from each other and said upper and lower elements of said blind extend substantially horizontally.

16. An apparatus according to claim 14, wherein said second connecting means has a central section thereof supported for angular movement about a second axis extending substantially perpendicularly to said elongated direction.

17. An apparatus according to claim 14, wherein said second connecting means has a central section thereof supported for angular movement about a second axis extending substantially perpendicularly to said elongated direction, and about an axis extending substantially along said longitudinal direction.

18. An apparatus according to claim 14, wherein said pair of brushes are mounted for angular movement relative to said washing-brush support means, about their respective axes extending substantially along said longitudinal direction.

19. An apparatus for washing a blind having a pair of upper and lower elements and a plurality of longitudinally extending blades arranged therebetween, said blind being movable between a collapsed configuration where said upper and lower elements are located close to each other with said blades closely spaced relative to one another therebetween and an extended position wherein said upper and lower elements are spaced apart from each other with said blades being spaced further from one another than when in said collapsed configuration, said apparatus comprising:

washing means for washing said blind including a tank for containing a washing liquid and a pair of brushes mounted within said tank, said pair of brushes extending in a corresponding longitudinal direction as said elongated blades and being arranged in opposed relation to each other, means for moving said blades in said extended position of said blind between said pair of brushes and between a first position wherein said blades are within said tank and a second position wherein said blades are removed from said tank; and means for supporting said blind in said extended position and reciprocating said blind relative to said washing means between said first and second positions, said support means having a pair of washing-brush supports for supporting respectively said pair of brushes, said pair of washing-brush supports being supported for horizontal reciprocative movement toward and away from each other between said first and second positions by said support means to enable said brushes and said washing liquid to wash said blades.

20. An apparatus according to claim 19, wherein said first and second positions are vertically spaced from each other and said upper and lower elements of said blind extend substantially horizontally.

* * * * *